US008439722B2

(12) United States Patent
Buriak

(10) Patent No.: US 8,439,722 B2
(45) Date of Patent: May 14, 2013

(54) RECOVERY BRA

(76) Inventor: Susan Buriak, Edmond, OK (US)

( * ) Notice: Subject to any disclaimer, the term of this patent is extended or adjusted under 35 U.S.C. 154(b) by 562 days.

(21) Appl. No.: 12/685,659

(22) Filed: Jan. 11, 2010

(65) Prior Publication Data

US 2010/0178847 A1 Jul. 15, 2010

Related U.S. Application Data

(60) Provisional application No. 61/143,749, filed on Jan. 9, 2009.

(51) Int. Cl.
*A41C 3/00* (2006.01)

(52) U.S. Cl.
USPC ..... 450/86; 450/59; 450/71

(58) Field of Classification Search ..... 450/58, 450/59, 62–64, 71, 73, 77–79, 82–86, 88
See application file for complete search history.

(56) References Cited

U.S. PATENT DOCUMENTS

| | | | | | |
|---|---|---|---|---|---|
| 1,670,684 | A * | 5/1928 | Leuchtag | 450/51 |
| 2,455,036 | A * | 11/1948 | Boylan | 450/86 |
| 2,723,395 | A * | 11/1955 | Blatt | 450/60 |
| 3,040,750 | A * | 6/1962 | Hurwitz | 450/58 |
| 3,302,649 | A * | 2/1967 | Enrico | 450/63 |
| 3,847,158 | A * | 11/1974 | Guidoni | 450/68 |
| 4,031,900 | A * | 6/1977 | Guidoni | 450/69 |
| 4,269,191 | A * | 5/1981 | Evans | 450/64 |
| 5,098,331 | A * | 3/1992 | Corrado | 450/58 |
| 6,319,091 | B1 * | 11/2001 | Kilbride et al. | 450/17 |
| 6,857,936 | B2 * | 2/2005 | Jones et al. | 450/86 |
| 6,994,606 | B2 * | 2/2006 | Li | 450/82 |
| 2002/0022434 | A1 * | 2/2002 | Plourde et al. | 450/86 |
| 2003/0003844 | A1 * | 1/2003 | Jones et al. | 450/88 |
| 2003/0236054 | A1 * | 12/2003 | Chen | 450/82 |
| 2006/0003669 | A1 * | 1/2006 | Li | 450/58 |

* cited by examiner

*Primary Examiner* — Gloria Hale
(74) *Attorney, Agent, or Firm* — Mitchell K. McCarthy; McCarthy Law Group

(57) ABSTRACT

A brassiere garment and associated method for dressing is provided contemplating a strap that is operably trained around a user's back and sides, a cup attached at each end of the strap, and an adjustable attachment feature connecting the cups together.

17 Claims, 7 Drawing Sheets

RECOVERY BRA

RELATED APPLICATION

This application claims the benefit of the earlier filing date of U.S. Provisional Application No. 61/143,749.

BACKGROUND

Rotator cuff tears are a common source of shoulder pain, especially in athletes or specific occupations. The incidence of rotator cuff damage increases with age. Obesity is also associated with rotator cuff surgery. A host of conditions may be related to eventual surgical intervention including bone spurs, adhesive capsulitis, and tendon degeneration with partial or full tears. Shoulder dislocation and instability caused by trauma may also lead to surgical intervention. Standard of care includes conservative treatment with rehabilitative exercises and injections. In patients who do not respond to conservative care, surgical interventions are frequently undertaken. Although comprehensive epidemiological data is not available on the total number of procedures nationwide or worldwide, just one local Oklahoma City Clinic (HPI data) reported 751 rotator cuff surgical procedures on females between January 2004 and Dec. 31, 2008, or an average of 188 per year. The American Board of Orthopedic Surgeons reports over 25,000 members nationwide. Although the exact number of procedures is not available, it can be estimated to be in the range of 770,000 across 4100 clinics, assuming half of those Board certified specialize in shoulders, and an average practice size of three. At the low end assuming only a third of the Board members participate and assuming practice sizes of five physicians it could be estimated roughly 312,000 procedures are conducted on female patients. Regardless of method (open, mini-open, or arthroscopic) a significant period of partial disability is expected during which the patient is normally undergoing initial range of motion physical therapy. Most patients have a reduced functional range of motion for 4 to 6 months after surgery; however, this duration is patient specific and can be longer depending on factors such as the integrity of the joint prior to surgery, treatment compliance, complications and specifics of the surgical technique.

The primary muscles involved in rotator cuff disability are supraspinatus, infraspinatus, subscapularis and teres minor. These control the rotation of the arm around its long axis. Since it is advised that post surgically the shoulder should not be used with the elbow away from the side for at least 3 months after rotator cuff repair, activities of daily living are problematic on the affected side. (A less common shoulder arthroplasty or complete replacement is performed on arthritis patients (6,700 procedures in 2003 reported by Medicare). Routine tasks can become insurmountably difficult for a woman who becomes physically incapacitated.

People normally take for granted that they are able to be self-sufficient, especially in very personal matters like dressing and undressing herself. When an incapacitating event occurs, such as shoulder injury or amputation, a woman can become traumatized as the pain associated with the incapacitation is compounded by the vulnerability she faces in not being able to carry out simple tasks as before.

This difficult situation is particularly troublesome when it comes to dressing and undressing of brassieres, and is a common inquiry regarding post operative care—one which most physicians are at a loss to answer. These issues do not normally come into play when a woman selects her choice of brassiere ("bra") undergarments. That is, typically it requires two good hands and arms and a requisite amount of physical dexterity to put a bra on and take it off. In some cases, for example, the closure is located against the woman's back requiring contorting both arms and hands to the mid-back section, or otherwise spinning the clasped bra around her torso and/or lifting the bra over her head. These types of body motions can be impossible or too painful to perform because of a physical incapacity. Also, the weight-bearing straps that typically are trained over the shoulders can be excruciating to get over an incapacitated arm, and can be invasive to the incisions and pain catheters in situations like shoulder surgery, where days or even weeks post surgery, one arm is limp, weak, lacking sufficient dexterity and strength to work straps and lift anything at all. When still under the effects of nerve block for approximately three days post surgery, assistance must be used to even lift the arm as it is numb, dead weight.

What is needed is a bra that enables a woman to carry on with her dignity in personal matters like dressing and undressing herself in the wake of such a physically incapacitating event, especially in light of her attendance at physical therapy sessions and other visits in a public setting. It is to improvements in the art directed to that need that the present embodiments are directed.

SUMMARY

The claimed embodiments generally contemplate an apparatus and associated method for dressing with a brassiere garment with limited mobility.

In some embodiments a brassiere garment is provided having a strap that is operably trained around a user's back and sides, a cup attached at each end of the strap, and an adjustable attachment feature connecting the cups together.

In some embodiments a method is provided for dressing with a brassiere garment, including steps of obtaining a brassiere garment that has a strap that is operably trained around a user's back and sides, a cup attached at each end of the strap, and an adjustable attachment feature connecting the cups together; placing the brassiere garment on a support surface; attaching a support member to one of the cups; folding the brassiere garment over the user while remaining on the support surface; and attaching the other cup to the support member.

In some embodiments a brassiere garment is provided having a strap that is operably trained around a user's back and sides, a cup attached at each end of the strap, and a tab depending from each cup that is operably selectively positionable in relation to a common support member and attachable to the support member via a hook-and-loop type fastener for connecting the cups together.

DETAILED DESCRIPTION

Figure 1:
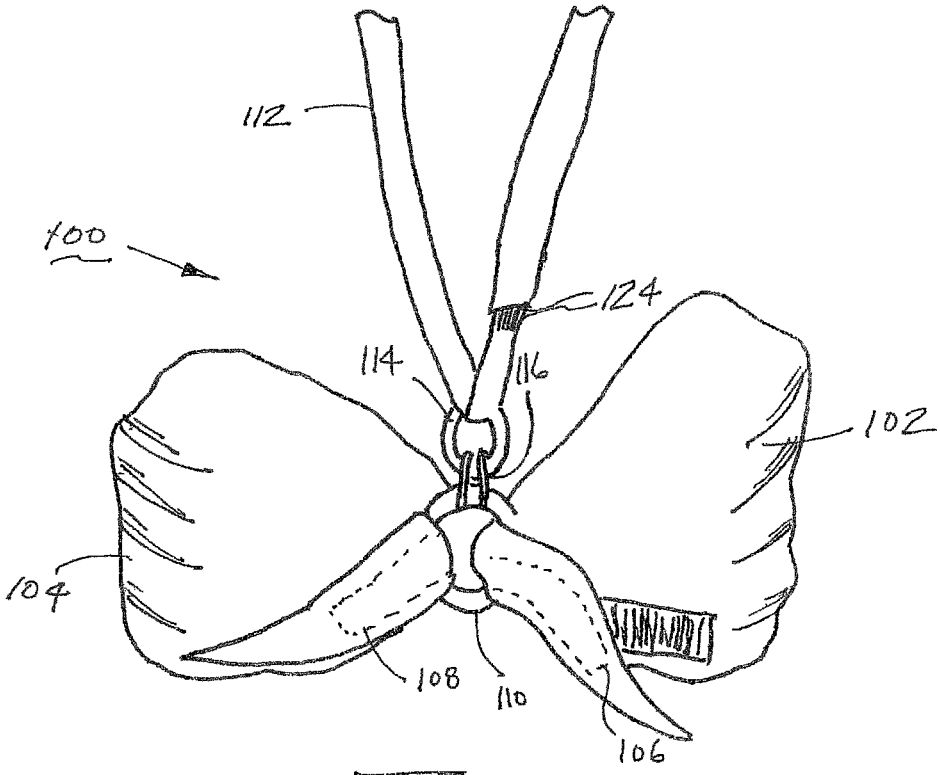
FIG. 1 is an elevational depiction of a bra utilized with the optional neck strap that is constructed in accordance with the present embodiments.

Turning to the FIGS. and first in particular to FIG. 1 which depicts a front elevational view of a bra 100 that is constructed in accordance with the present embodiments. The bra 100 has a left-cup 102 and a right cup 104 that cover and support the user's left and right breasts, respectively. Extending from a distal end of each cup 102, 104 is a closure tab 106, 108 that is sized to be insertable through and thereby form a hooking attachment to a bra ring (sometimes referred to as a "front closure member") 110.

It will be understood from the description that follows that in some embodiments the user will be satisfied with the support provided only by the bra 100. Optionally, the user can obtain additional lifting support by using a neck strap 112. The neck strap 112 is sized to be insertable through and thereby form a hooking attachment to a strap ring 114. A clasp 116 can operably connect the bra ring 110 to the strap ring 114.

Figure 2:
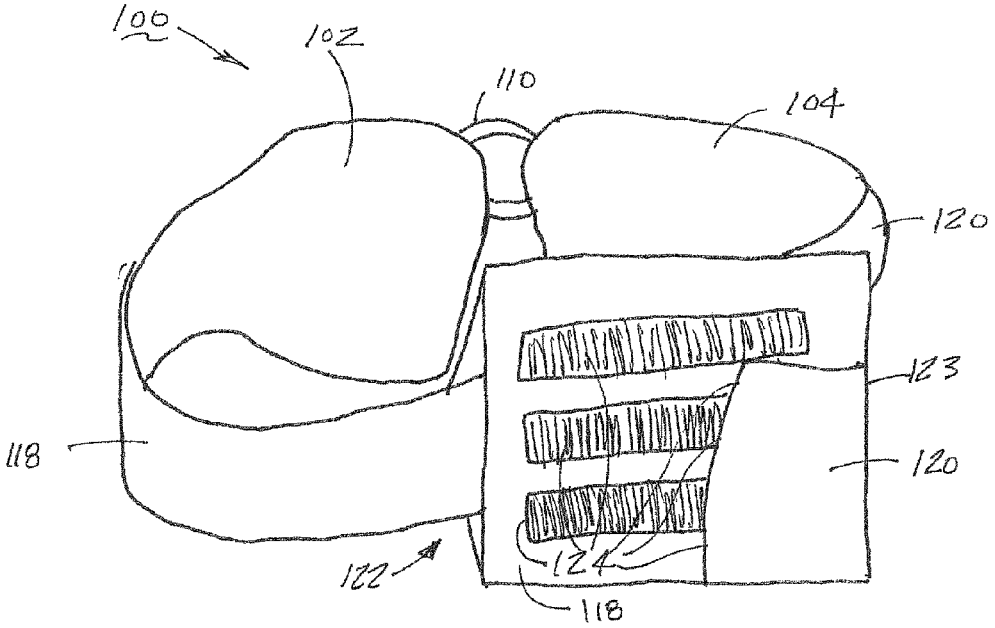
FIG. 2 is a rear view of the bra of FIG. 1 with an enlarged detail view of the adjustable rear closure.

FIG. 2 is a rear view of the bra 100 of FIG. 1 depicting each of the cups 102, 104 being connected to respective straps (straps combined referred to as a "torso strap") 118, 120 that are separable at distal ends thereof and joined by a rear adjustable fastener 122 to adjust the size of the bra 100 for the user's girth and comfort. In the embodiments of FIG. 2 the rear adjustable fastener 122, depicted in an enlarged detail view 123, employs a hook-and-loop type of cloth fastener 124, such as Velcro® strips, attached to each of the straps 118, 120. It will be noted that a sufficient longitudinal length of the cloth fasteners 124 is provided so that the extent to which the straps 118, 120 overlap in the closed position can be varied in relation to the desired circumference of the bra 100 around the user's torso. The rear adjustable fastener 122 of the present embodiments are not so limited to this construction, such that other types of adjustable fasteners such as but not limited to rows of hooks and clasps, and the like, can likewise be used. The pre surgical adjustability, movement and comfort are key features of the bra 100 provided by the rear adjustable fastener 122.

Figure 3:
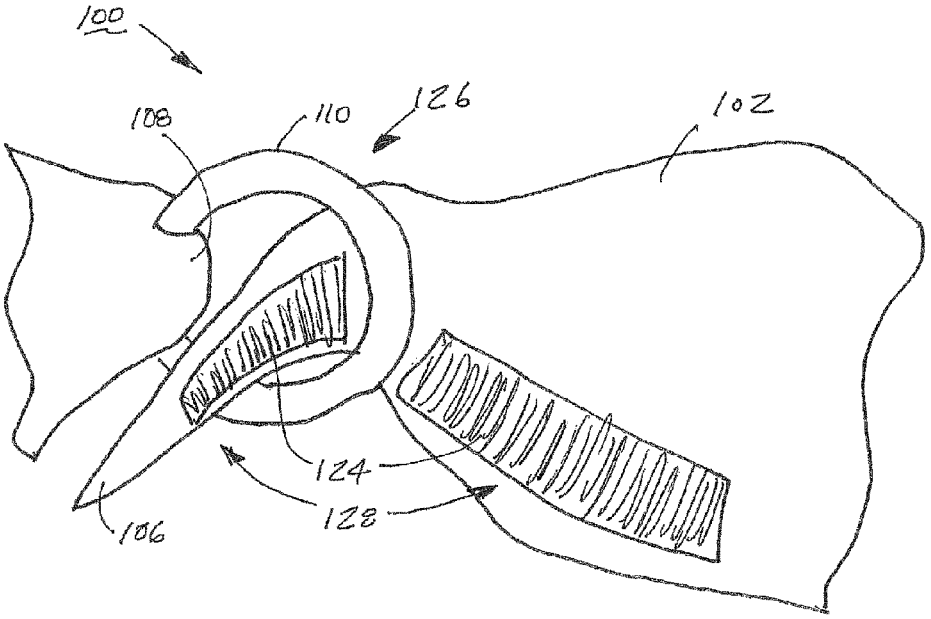
FIG. 3 is an enlarged view of the bra of FIG. 1 detailing the adjustable front closure.

FIG. 3 is an enlarged detail view of a front adjustable fastener 126 for attaching the cups 102, 104 to the bra ring 100 in a manner that adjusts the size of the bra 100 for the user's breast size and comfort. In the embodiments of FIG. 3 the front adjustable fastener 126 employs another cloth fastener 124 attached to the tab 106 and to the cup 102. Although not depicted, it will be understood that the other tab 108 is adjustably attachable to its respective cup 104 in the same manner. The tab 106 is inserted through the bra ring 110 and then folded over in direction 128 to connect the cloth fastener 124. It will be noted that a sufficient longitudinal length of the cloth fastener 124 is provided so that the extent to which the tab 106 is inserted into and folded over the bra ring 110 can be varied to selectively determine the size of the cup 102 in relation to the user's breast size.

From the foregoing it is important to note that the rear adjustable fastener 122 and the front adjustable fastener 126 of the present embodiments make it possible for one-size-fits all construction. That is, users of various different girths, breast sizes, and desired lift and comfort levels can all use a commonly manufactured bra 100 because it is readily suited for individual adjustment. These features simplify manufacturing and distribution of the bra 100, and assist the medical supplier in meeting the patient's needs without the concern of supplying proper size or style. A special order extra extra small or extra extra large customization can be arranged in certain but rare circumstances to accommodate XXS, XXXS, XXL, and XXXL patients.

Again, in some circumstances the user will be satisfied with the lift and support provided entirely by the bra 100. However, in other circumstances the user will prefer the additional lifting support afforded by the neck strap 112. Returning to FIG. 1 momentarily, in keeping with the one-size-fits-all advantages of the present embodiments, the neck strap 112 is a discontinuous loop that is selectively attachable at its ends such as by another cloth fastener 124 to form a desired drop above the bra ring 110. In the embodiments of FIG. 1 the neck strap 112 hookingly engages the strap ring 114. The clasp 116 hookingly links the bra ring 110 to the strap ring 114.

Figure 4:
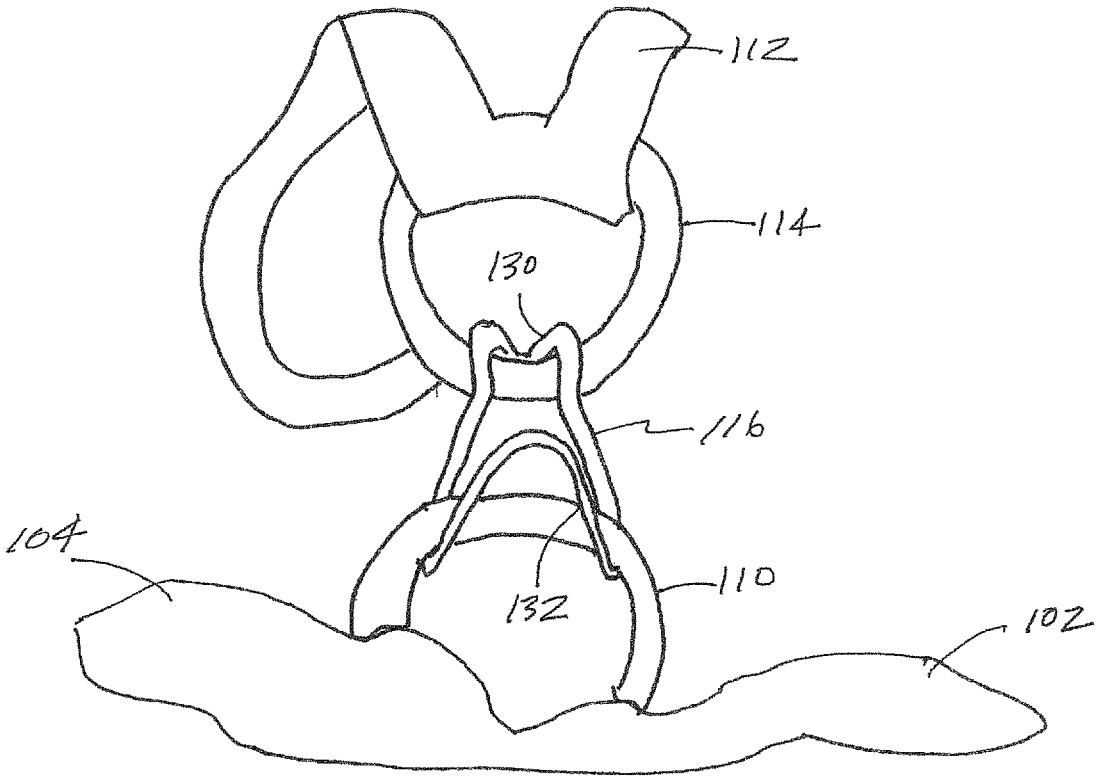
FIG. 4 is an enlarged view of the bra of FIG. 1 detailing the clasp that operably connects the neck strap to the bra.

FIG. 4 is an enlarged detail view of the clasp 116 that forms a first hook 130 at an upper end thereof for engaging the strap ring 114. The clasp 116 similarly forms a second hook 132 at a lower end thereof for hookingly engaging the bra ring 110. Advantageously, by first hooking the first hook 130 to the strap ring 114, the user can then simply and easily connect the neck strap 112 to the bra 100 by an upward motion of the hook 132 to engage the bra ring 110. The neck strap, previously set to the correct length prior to surgery, is tossed over the head with the non affected arm, and upward motion to attach the hook 132 is easily accomplished with only one hand, accomplishing the desired solution of the present embodiments. The clasp 116 is held in place by the additional support the neck strap 112 provides, and the attachment adds additional support for larger busted women. The rings 110, 114 and the clasp 116 in these illustrative embodiments are constructed of a rigid durable material such as a food grade polyethylene or the like, or a metal, in order to minimize the frictional engagements therebetween. Furthermore, the radiused surface of the rings 110, 114 can be fashioned to minimize the frictional engagement with the items they engage. This type of construction provides the most desirable comfort level to the user, in that the linkage between the neck strap 112 and the bra 100 is extremely fluid in response to the user's body movements. The clasp 116 is hooked to the ring 114 to provide a stable yet flexible attachment.

Figure 5:
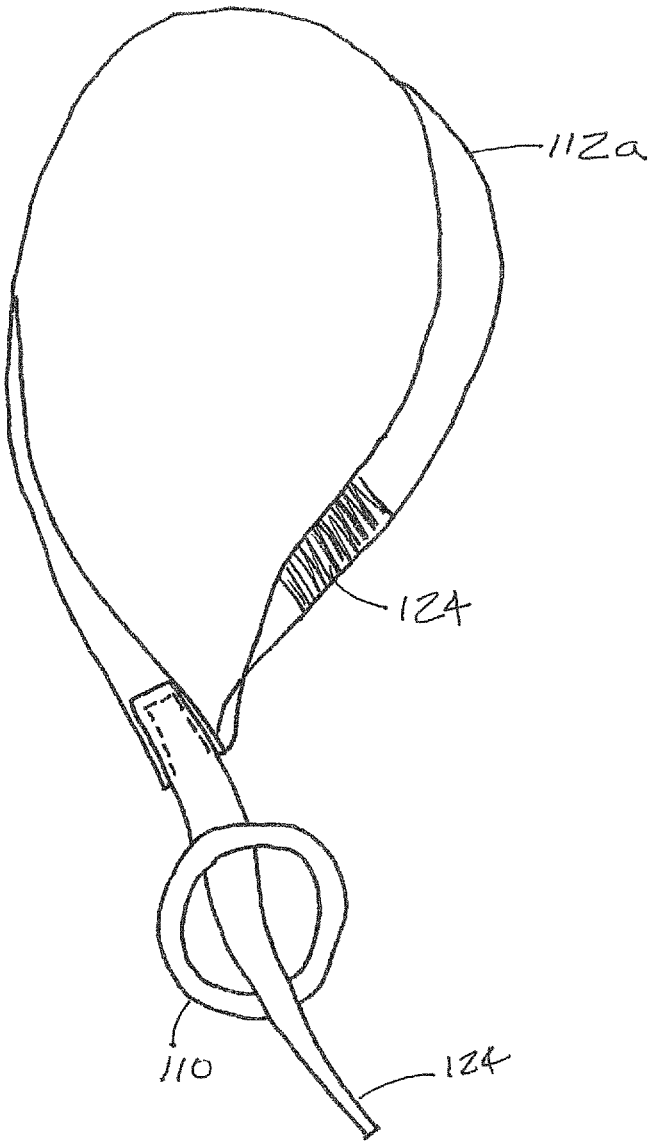
FIG. 5 is an isometric depiction of a neck strap that is constructed in accordance with alternative embodiments.

It will be understood that in alternative equivalent embodiments a less complex and thereby less expensive construction can be provided, such as but not limited to the embodiments depicted by FIG. 5. The neck strap 112*a* in FIG. 5 simply loops through and hookingly engages the bra ring 110 directly, thereby eliminating the need for the strap ring 114 and clasp 116. The neck strap 112 a depicted in FIG. 5 is constructed of a fixed-size loop, but alternatively it can be an adjustable-size loop as described above. This reduced-cost solution might require a relatively greater patient level of post surgical dexterity to use.

Figure 6:
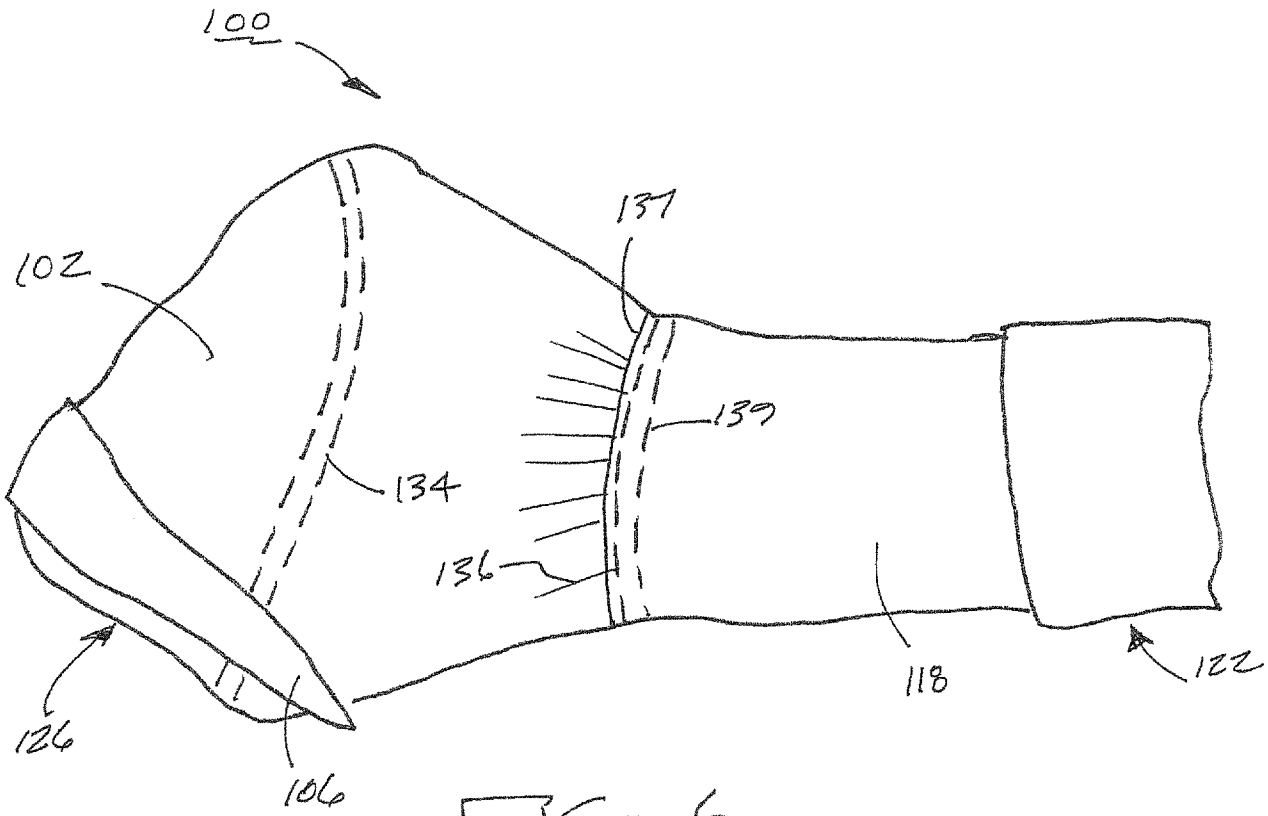
FIG. 6 is a side view of the bra of FIG. 1 in an operably closed position.

FIG. 6 is a side view of the bra 100 in the operably closed position, that is, with both the rear adjustable fastener 122 and the front adjustable fastener 126 selectively sized and closed. A supporting stay 134 can be sewn into each of the cups 102, 104 to afford additional support to the user's breasts. Additional support is also provided by the gathers 136 provided by the seam 137 around a supporting stay 139 at the attachment of the cups 102, 104 to the respective straps 118, 120.

Figure 7:
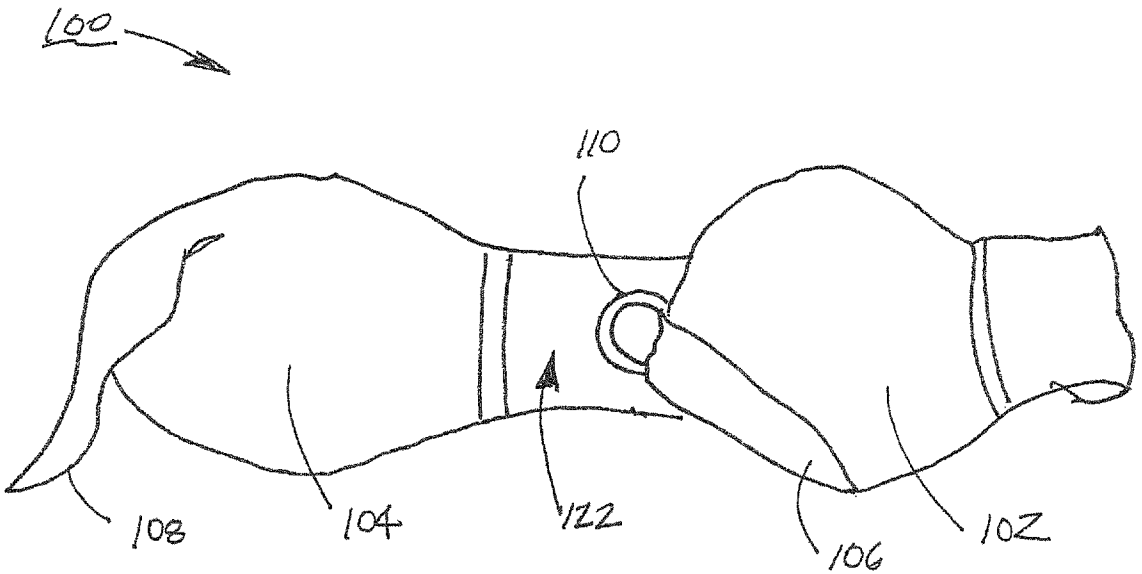
FIG. 7 is a top view of the bra of FIG. 1 depicting initial steps in a method for putting on the bra of FIG. 1 wherein the bra is laid flat, the bra ring is attached to one of the cups, and then that cup is folded over in a closed position such that the folded-over cup encloses the user's left-side breast.

FIG. 7 is a top view illustrating initial steps in an illustrative method for a user to put the bra 100 on. The rear adjustable fastener 122 is first sized and connected. Since the bra 100 is being used in rehabilitating from surgery, then the setting for the rear adjustable fastener 122 is preferably done prior to the surgery. The bra ring 110 is connected to one of the closure tabs 106, 108 at the desired size; in FIG. 2 the bra ring 110 is connected to tab 106. Preferably, the ring is attached to the cup 102, 104 associated with the injured side of the user's body.

Figure 8:
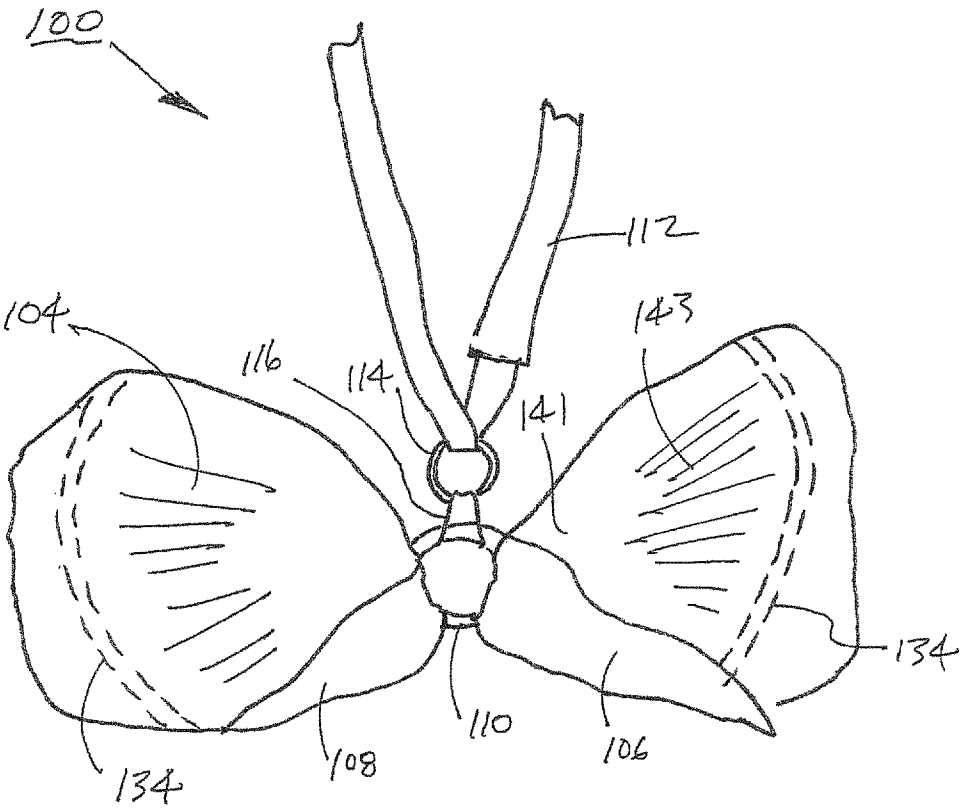
FIG. 8 is top view depicting final steps in the method for putting on the bra of FIG. 1 wherein the other cup is folded over to enclose the user's other breast and attached to the bra ring and tightened. The pre adjusted neck strap provides a desired length, and the neck "loop" is tossed over the head with the unaffected arm using a simple upward motion and connected to the bra 116.

The bra 100 is then placed on a supportive and substantially flat surface, such as the top of a bed, with the outer surfaces of both cups 102, 104 facing the flat surface. The user can then recline her back against the bra 100 and fold the cup 102 over to enclose her (in this illustration) left breast. FIG. 8 depicts a continuation of this method after the user has similarly folded over the other cup 104 to enclose her right breast and hooked the tab 108 through the bra ring 110. The partially incapacitated person is able to put on the bra 100 since sufficient strength is available using the unaffected arm to secure and tighten the fits without any impact on the disabled side, which is hanging limp or nearly immobile from pain medications, pain pump, or too fragile to move due to sutures. The bra 100 allows the woman to dress herself and is adjustable with use of only the non affected arm.

The bra 100 and optional neck strap 112 are preferably made of a fabric providing a desired comfort to the user, such as but not limited to a synthetic material with superior elasticity characteristics such as but not limited to Lycra® or more generally referred to as spandex knit. The chain stitch and nylon thread is employed to facilitate proper stretching of the material. Other features of construction not detailed will be understood to the skilled artisan, such as the type and placement of seams in joining panels of the fabric such as to place the seams away from the user's skin and to prevent direct contact with the stays 134, 139.

Referring momentarily to FIGS. 6 and 8, for example, the seam 137 forming the gathers 136 provides a somewhat expandable end of the cup 102 that is tapered sufficiently to be wide enough to cover the breast comfortably while providing the desired support at the end adjacent the strap 118. Another seam 141 likewise forms gathers 143 to provide a similarly somewhat expandable end of the cup 102 that is tapered sufficiently to be wide enough to cover the breast comfortably while providing the desired support at the other end adjacent the closure tab 106.

The described construction of the bra 100 and optional neck strap 112 enables the user to put the bra 100 on according to this illustrative method with only one hand, solving the need for the partially incapacitated person to dress and undress herself and attend required therapies and necessary trips outside the home with sufficient modesty and support. The optional neck strap is sized prior to the surgery using the Velcro tab. The loop can then be tossed over the head with the non affected arm. The clasp is designed ergonomically to be connected with a slight upward motion using the non affected arm. The materials and construction of the clasp may be a single lightweight yet sturdy, injection molded plastic in the final design.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims express. The particular elements may vary in type or arrangement without departing from the spirit and scope of the present invention. For example, without limitation, although Velcro® type cloth fasteners are depicted in the embodiments disclosed above, the contemplated scope of the invention is not so limited such that other types of fasteners and adjustment mechanisms can readily be substituted and otherwise used in equivalent alternative embodiments.

In addition, although the embodiments described herein are directed to illustrative embodiments for adjustable sizing and attaching the rear adjustable fastener and front adjustable fastener for a bra, it will be appreciated by those skilled in the art that the claimed subject matter is not so limited and various other systems can utilize the present embodiments without departing from the spirit and scope of the claimed invention.

What is claimed:

1. A brassiere, comprising:

a torso strap that is operably trained around a user's back and sides;

a first cup attached at one end of the torso strap and a second cup attached at the other end of the torso strap;

a closure tab extending from the first cup; and an annular front closure member operably attached to the second cup and through which the closure tab is operably insertable and then adjustably connectable to maintain a hooked engagement of the closure tab to the annular front closure member connecting the cups together on the user's torso, the annular front closure member sized to also be connectable to a neck strap that is operably trained around the user's neck to support the cups.

2. The brassiere of claim 1 wherein the closure tab is operably selectively adjustably connectable in relation to a force applied to the closure tab in a direction substantially away from the second cup.

3. The brassiere of claim 1 wherein the closure tab is operably adjustably connectable via a hook-and-loop type fastener.

4. The brassiere of claim 1 wherein the annular front closure member is characterized as a ring.

5. The brassiere of claim 1 wherein the closure tab is characterized as a first closure tab, further comprising a second closure tab extending from the second cup, each closure tab being individually insertable through the annular front closure member and then adjustably connectable to maintain respective hooked engagements of the closure tabs to the annular front closure member.

6. The brassiere of claim 5 wherein both closure tabs are operably adjustably connectable via hook-and-loop type fasteners.

7. The brassiere of claim 6 wherein both closure tabs are operably insertable and adjustably connectable without contacting each other.

8. The brassiere of claim 1 wherein the neck strap comprises an adjustment feature operably connecting to the annular front closure member.

9. The brassiere of claim 8 wherein the adjustment feature comprises a tab portion of the neck strap that is selectively positionable and operably attachable to another portion of the neck strap.

10. The brassiere of claim 9 wherein the tab portion of the neck strap is operably attachable to the other portion of the neck strap via a hook-and-loop type fastener.

11. The brassiere of claim 1 wherein the neck strap operably connects to the annular front closure member via a clasp.

12. The brassiere of claim 11 wherein the neck strap supports a second annular front closure member and the clasp operably joins the first and second annular front closure members together.

13. The brassiere of claim 1 wherein the torso strap comprises a torso strap adjustment feature to operably vary a separation between the cups opposite the separation provided by the annular first closure member.

14. The brassiere of claim 13 wherein the strap adjustment feature comprises segmented portions of the torso strap operably joined by a fastener.

15. The brassiere of claim 14 wherein the fastener comprises a hook-and-loop type fastener.

16. A method enabling a user having only one useable arm/hand to put on a brassiere, comprising:

obtaining a brassiere that has a torso strap that is sized to fit around a user's back and sides, a first cup attached at one end of the torso strap and a second cup attached at the other end of the torso strap, a closure tab extending from the first cup, and an annular front closure member;

folding the brassiere over the user's torso with the user's one arm/hand;

after the folding, inserting the closure tab through the annular front closure member and then pulling the closure tab away from the second cup, hooking the closure tab to the annular front closure member with the user's one arm/hand;

after the inserting and pulling, attaching the closure tab in a selected position to maintain the hooking engagement of the closure tab to the annular front closure member with the user's one arm/hand; and selectively training a neck strap around the user's neck and attaching the neck strap to the annular front closure member.

17. The method of claim 16 wherein the obtaining step is characterized by the closure tab being a first closure tab and further having a second closure tab extending from the second cup, and wherein the attaching step is characterized by attaching both tabs via respective hook-and-loop type fasteners.

* * * * *